United States Patent [19]

Coburn et al.

[11] 4,266,564

[45] May 12, 1981

[54] COIN RELEASE ASSEMBLY

[75] Inventors: C. David Coburn, Muskogee; Rex M. Maloy, Broken Arrow, both of Okla.

[73] Assignee: Orin W. Coburn, Muskogee, Okla.

[21] Appl. No.: 80,681

[22] Filed: Oct. 1, 1979

[51] Int. Cl.[3] ..... G07D 1/00

[52] U.S. Cl. ..... 133/5 R; 221/274

[58] Field of Search ..... 133/4 R, 4 A, 5 R, 5 A; 221/274, 276

[56] References Cited

U.S. PATENT DOCUMENTS

| | | | |
|---|---|---|---|
| 542,328 | 7/1895 | Brandt . | |
| 1,136,801 | 4/1915 | Hofmann . | |
| 1,157,826 | 10/1915 | Walker et al. . | |
| 1,168,582 | 1/1916 | Vogelsong . | |
| 1,231,578 | 7/1917 | Dunlany . | |
| 1,231,858 | 7/1917 | Daniel . | |
| 1,279,598 | 9/1918 | Skerl . | |
| 1,385,359 | 7/1921 | Bruhn et al. . | |
| 1,571,618 | 2/1926 | Bell . | |
| 2,250,051 | 7/1941 | Patzer . | |
| 2,267,599 | 12/1941 | Bradt . | |
| 2,531,502 | 1/1952 | Wallin . | |
| 2,653,850 | 9/1953 | Vollten . | |
| 2,664,984 | 1/1954 | Eierman . | |
| 2,690,828 | 10/1954 | Staiger . | |
| 2,691,379 | 10/1954 | Foushee . | |
| 2,705,964 | 4/1955 | Bernstein . | |
| 2,732,054 | 1/1956 | Hehn . | |
| 2,763,272 | 9/1956 | Patzer | 133/4 R X |
| 2,778,368 | 1/1957 | Jaskowiak . | |
| 2,973,076 | 2/1961 | Hatcher . | |
| 3,135,271 | 6/1964 | Krakauer et al. . | |
| 3,167,078 | 1/1965 | Trautenberg . | |
| 3,180,343 | 4/1965 | Gecewicz . | |
| 3,200,828 | 8/1965 | Offutt et al. . | |
| 3,215,151 | 11/1965 | Heim et al. . | |
| 3,251,369 | 5/1966 | Staar . | |
| 3,343,553 | 9/1967 | Whitmore . | |
| 3,360,091 | 12/1967 | Baum . | |
| 3,599,648 | 8/1971 | Stewart | 133/5 |
| 3,713,562 | 1/1973 | Kull | 221/125 |
| 3,814,115 | 6/1974 | Van Acker | 133/4 |
| 3,934,753 | 1/1976 | Curtiss | 221/93 |
| 3,935,873 | 2/1976 | Johnson | 133/5 R |
| 3,972,338 | 8/1976 | Schmitt | 133/4 A |
| 4,010,765 | 3/1977 | Clay | 133/4 A |

*Primary Examiner*—F. J. Bartuska

*Attorney, Agent, or Firm*—Dunlap, Codding & McCarthy

[57] ABSTRACT

A coin release assembly for selectively removing a coin element from a coin tube retaining a plurality of coin elements, the coin tube having a coin exit end with a coin exit opening formed through the coin exit end to permit discharge of the coin elements therethrough, the assembly comprising a base plate having an opening extending therethrough, the opening in the base plate being offset with respect to the coin exit opening of the coin tube such that a portion of the base plate supports the coin elements within the coin tube, and a coin ejecting assembly movable from a first position to a second position, the coin ejecting assembly engagable with a lowermost coin element supported in the coin tube by the base plate for moving the engaged coin element to the opening in the base plate for discharging the coin element through the opening in the base plate.

20 Claims, 12 Drawing Figures

COIN RELEASE ASSEMBLY

BACKGROUND OF THE INVENTION

1. Field of the Invention

The present invention relates to a coin release assembly, and more particularly, but not by way of limitation, to a coin release assembly for selectively removing a coin element from a coin tube in which the coin elements in the coin tube are selectively moved by a coin ejecting assembly from a first position wherein the coin elements are disposed in the coin tube to a second position for exiting the coin release assembly.

2. Description of the Prior Art

Various types of coin release assemblies have heretofore been proposed for use in combination with apparatus to vend articles and services by machines which can remain unattended over relatively long periods of time. Such vending machines are usually provided with a device for sorting coins inserted into the machine through a deposit slot, and a coin detecting assembly which reads and sorts the coins thus automatically initiating the vending cycle when coins making up the required price of the article or service have been inserted into the machine. Various types of coin release assemblies have also been proposed for making change in such vending machines when change is to be returned to the customer equal to the excess deposit which the person has inserted into the machine over and above the price of the article or service purchased. However, the prior art coin release assemblies employed for making change in vending machines have suffered from an inherent defect of requiring considerable space in the vending cabinet to accommodate the change coins dispensed during the change making cycle of the apparatus; or, have required complicated mechanical arrangements which are often subject to malfunction and breakdown. In addition, many of the prior art coin release assemblies employed with vending machines have required the coin release assembly to support the coins in the coin tube which has resulted in frequent malfunctions and breakdowns of the coin release assembly. Attempts to solve such problems in the coin release assemblies of the various types of change making devices of the prior art have generally led to very complicated and expensive mechanisms which, although operable for certain specific purposes, are not completely practical from a commercial and economical standpoint because of the space limitations and reliability factors required in present day vending equipment.

It is therefore an object of the present invention to provide an improved coin release assembly for use with vending machines or the like wherein coin elements can be removed from a coin tube in a selected, controlled manner.

Another object of the present invention is to provide a coin release assembly for selectively removing a coin element therefrom wherein the coin elements disposed within a coin tube are not supported by the coin release assembly.

Another object of the invention is to provide an improved coin release assembly having a substantially reduced number of moving parts and assemblies thereby substantially reducing the required maintenance and possibility of malfunction of the assembly.

Another object of the invention is to provide an improved coin release assembly which can readily be employed in vending machines, or the like, for returning a predetermined amount of money to a customer which is economical to manufacture, durable in construction, and does not suffer from the disadvantages of the prior art devices.

Other objects, advantages and features of the present invention will be evident to those skilled in the art from the following detailed description when read in conjunction with the accompanying drawings which illustrate preferred embodiments of the invention.

DESCRIPTION OF THE PREFERRED EMBODIMENTS

Figure 1:
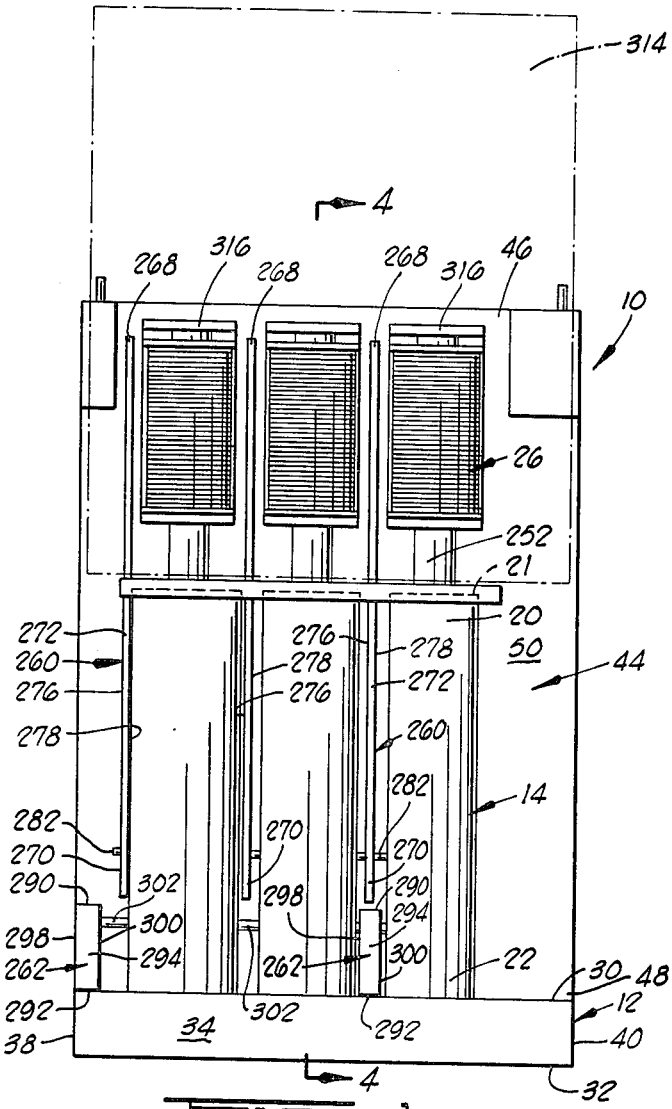
FIG. 1 is a front elevational view of the coin release assembly of the present invention, depicting in phantom a coin separator assembly for dispensing selected coin elements into the coin tubes of the coin release assembly.

Referring to the drawings in general, and to FIGS. 1 through 7 in particular, shown therein and designated by the general reference numeral 10, is a coin release assembly constructed in accordance with the present invention. As shown more clearly in FIGS. 1, 2, 4 and 5, the coin release assembly 10 comprises a base plate 12, a coin tube 14 (three being depicted in FIG. 1) and a coin ejecting assembly 16. The base plate 12 is provided with an opening 18 extending therethrough, the configuration of the opening 18 and its cooperation with the coin ejecting assembly 16 will be more fully described hereinafter. The coin tube 14 is provided with a first end (a coin entrance end) 20 having a coin entrance opening 21, an opposed second end (a coin exit end) 22 having a coin exit opening 23, and a coin passageway 24 extending therethrough. The opposed second end 22 of the coin tube 14 is secured to the base plate 12 such that the coin exit opening 23 of the coin passageway 24 of the coin tube 14 is in an offset relationship with the opening 18 in the base plate 12. Thus, a portion of the base plate 12 serves to support a plurality of the coin elements (not shown) in the coin passageway 24 of the coin tube 14.

Figure 7:
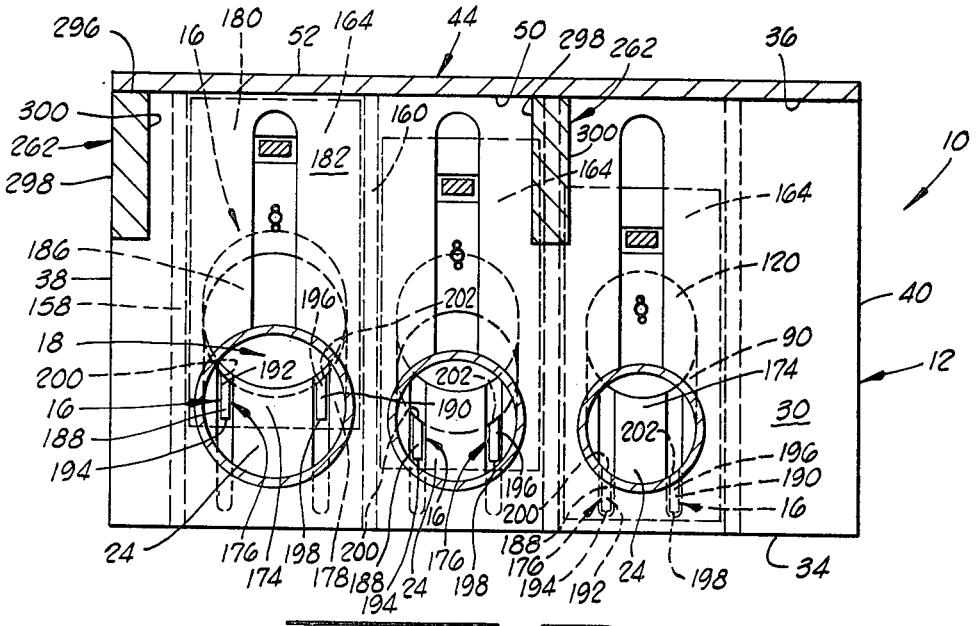
FIG. 7 is a cross sectional view taken substantially over the upper side of the base plate of the coin release assembly of FIG. 1, and at a position nearer the upper side of the base plate as compared to the view depicted in FIG. 6.

The coin ejecting assembly 16 is operably disposed in the base plate 12 such that the coin ejecting assembly 16 engages a lowermost coin element (not shown) in the coin passageway 24 of the coin tube 14. The coin ejecting assembly is operably connected to an activation unit, such as a solenoid 26, via a linkage assembly 28 so that upon activation of the solenoid 26 the linkage assembly 28 causes the coin ejecting assembly 16 to move from a first position (wherein the coin ejecting assembly 16 operably engages the lowermost coin element supported in the coin passageway 24 of the coin tube 14) to a second position wherein the coin element engaged by the coin ejecting assembly 16 is removed from the coin passageway 24 of the coin tube 14 and aligned with the opening 18 in the base plate 12 such that the coin element exits the base plate 12 via the opening 18 therein. Movement of the coin ejecting assembly 16 between the first position and the second position is depicted in FIG. 7 when FIG. 7 is viewed from the right to the left.

The base plate 12 is provided with an upper side 30, an opposed lower side 32, a first side 34, an opposed second side 36, a first end 38, and an opposed second end 40. The base plate 12 is further provided with a recessed portion 42 therein (shown in FIGS. 4 and 5), the recessed portion 42 establishing communication between the coin exit opening 23 of the coin tube 14 and the opening 18 in the base plate 12. The recessed portion 42 thus defines a coin element travel path between the opening 18 of the base plate 12 and the coin exit opening 23 of the coin tube 14. Further, the recessed portion 42 of the base plate 12 slidably receives the coin ejecting assembly 16. The base plate 12 is desirably formed of a multiplate construction as will be described hereinafter in detail.

Figure 2:
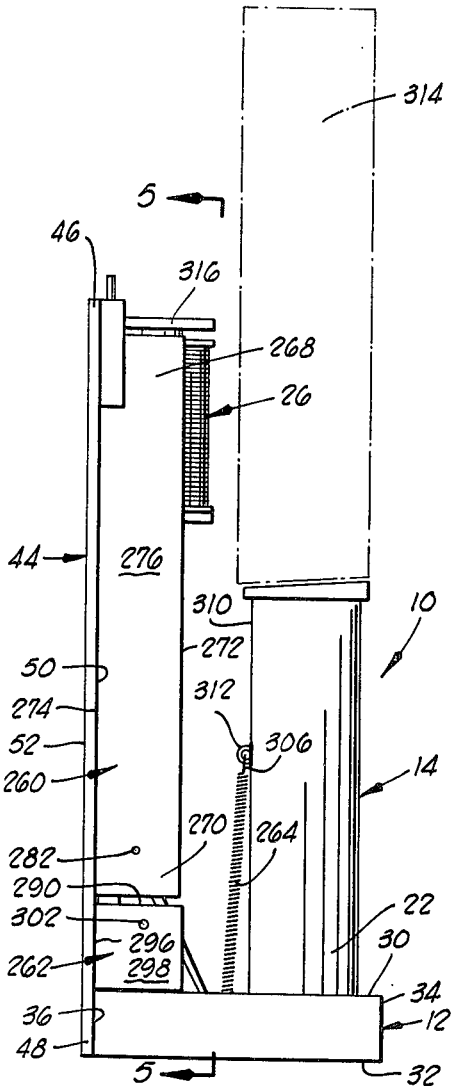
FIG. 2 is a side elevational view of the coin release assembly of the present invention, depicting in phantom a coin separator for dispersing selected coin elements into the coin tubes of the coin release assembly.
Figure 3:
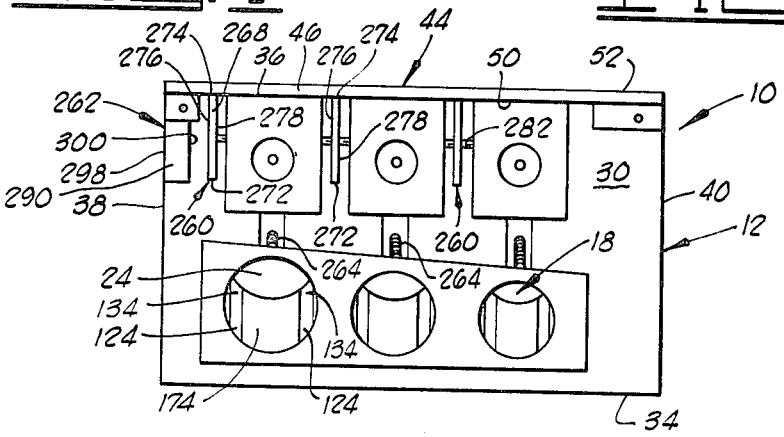
FIG. 3 is a top plan view of the coin release assembly of the present invention.

The coin release assembly 10 is further provided with a back support plate 44. The back support plate 44 is provided with an upper end portion 46, an opposed lower end portion 48, a front side 50, and an opposed back side 52. The opposed lower end portion 48 of the back support plate 44 is secured through the front side 50 of the back support plate 44 to the opposed second side 36 of the base plate 12 such that the back support plate 44 extends substantially vertically from the base plate 12 and substantially parallel to the coin tube 14 as shown in FIGS. 2 and 4.

Figure 4:
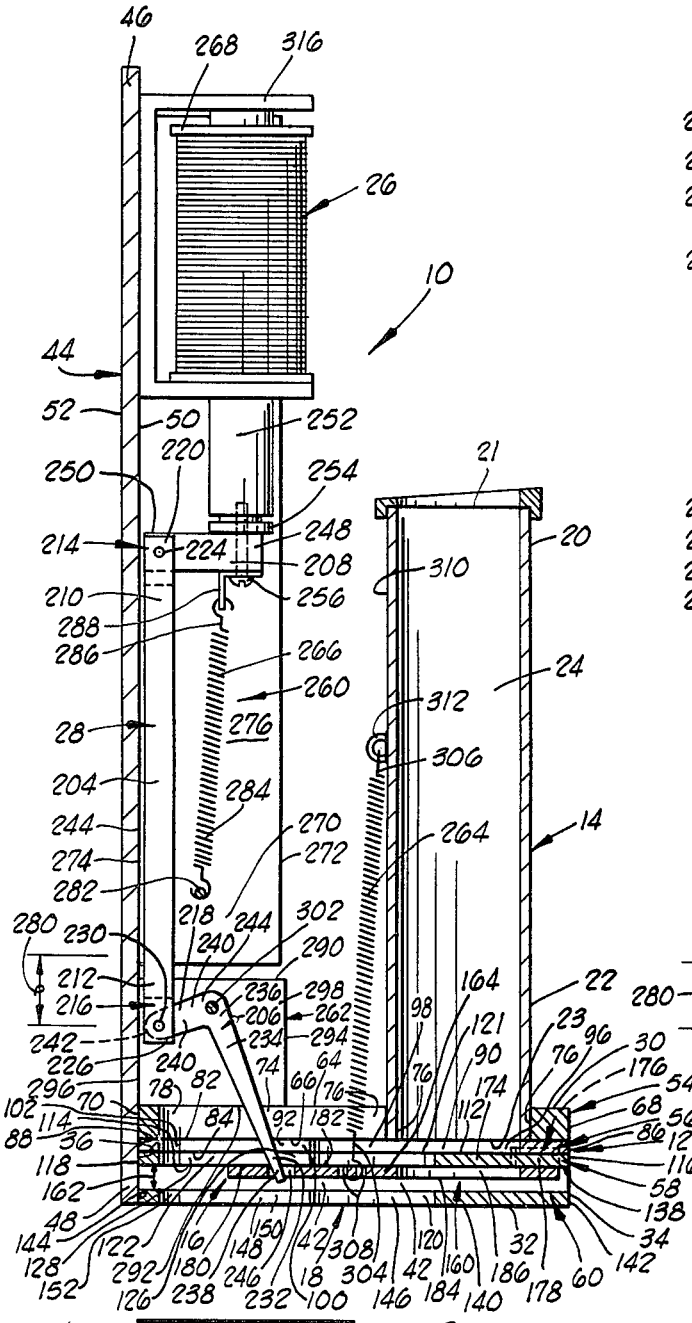
FIG. 4 is a cross sectional view of the coin release assembly of FIG. 1 taken along the line 4—4.
Figure 5:
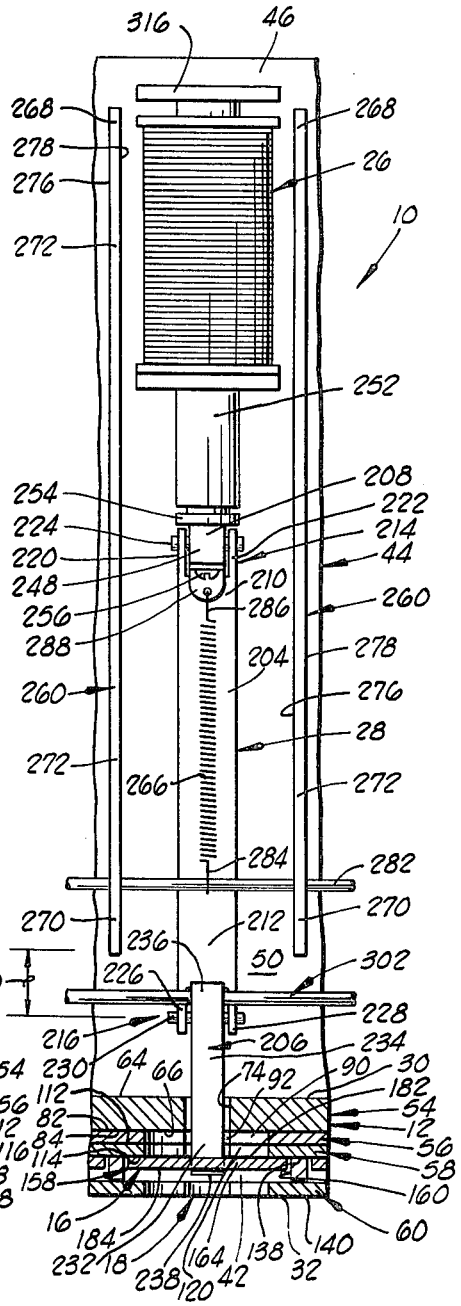
FIG. 5 is a cross sectional view of the coin release assembly of FIG. 2 taken along the line 5—5.

Referring now to FIGS. 8A–8E, in combination with FIGS. 4 and 5, the construction of the base plate 12, and its relationship with the coin ejecting assembly 16 are more clearly depicted. As previously stated, the base plate 12 is desirably formed of a multiplate construction. Thus, the base plate 12 comprises an upper plate 54, a first intermediate plate 56, a second intermediate plate 58, a lower plate 60, and fastening means, such as screws 62, for securing the beforementioned plates together.

Figure 8E:
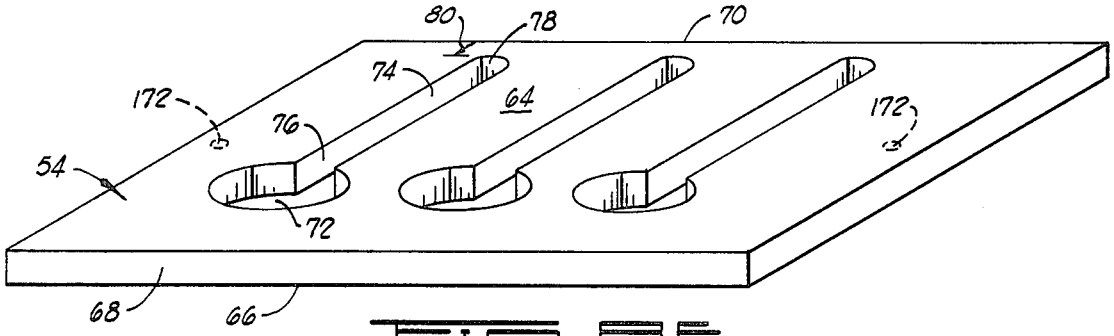
FIGS. 8A–8E are exploded, perspective views depicting the base plate and coin ejecting member of the coin release assembly of the present invention.
Figure 8D:
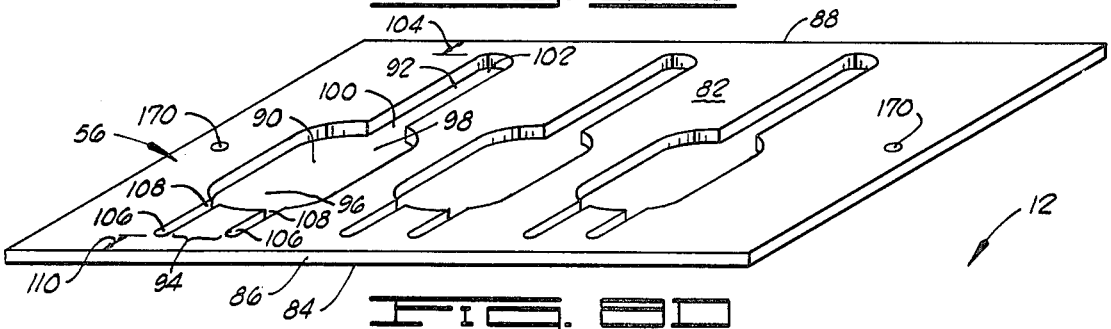
Figure 8C:
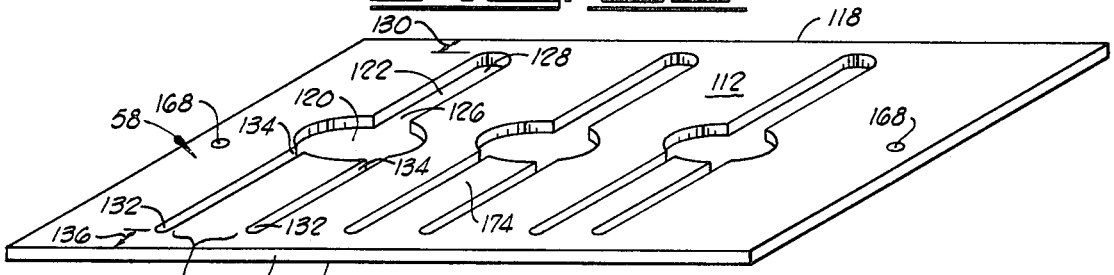
Figure 8B:
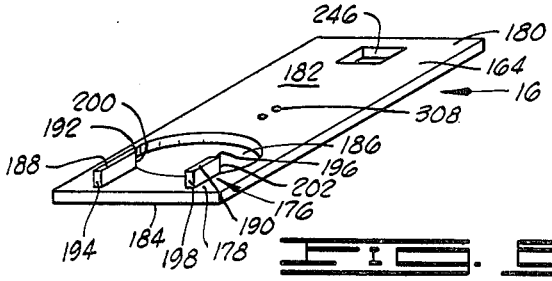

The upper plate 54 is provided with an upper side 64, an opposed lower side 66, a first side 68, and an opposed second side 70. Further, the upper plate 54 is provided with a first opening 72 and a first elongated clearance slot 74 extending therethrough. The first opening 72 of the upper plate 54 is positioned in close proximity to the first side 68 of the upper plate 54 substantially as shown in FIG. 8E. The first opening 72 is adapted to receive the opposed second end (the coin exit end) 22 of the coin tube 14 such that the coin tube 14 is disposed so that its longitudinal axis is substantially perpendicular to the longitudinal vertical axis of the upper plate 54 of the base plate 12 and substantially parallel to the longitudinal vertical axis of the back support plate 44. The first elongated clearance slot 74 is provided with a first end 76 and an opposed second end 78. The first end 76 of the first clearance slot 74 openly communicates with the first opening 72 of the upper plate 54; and, the opposed second end 78 of the first clearance slot 74 extends from the first opening 72 in the direction of the opposed second side 70 of the upper plate 54 and terminates a distance 80 from the opposed second side 70. The first opening 72 and the first elongated slot 74 of the upper plate 54 are positioned therein such that a central axis is common to each.

The first intermediate plate 56 of the base plate 12 is provided with an upper side 82, an opposed lower side 84, a first side 86, and an opposed second side 88. The first intermediate plate 56 is further provided with an elongated second opening 90 extending therethrough, a second elongated clearance slot 92, and a first pair of elongated guide slots 94. The elongated second opening 90 is provided with a first end portion 96 and an opposed second end portion 98. The first end portion 96 of the elongated second opening 90 is disposed between the first side 86 and the opposed second side 88 and is alignable with the first opening 72 of the upper plate 54 when the upper plate 54 and the first intermediate plate 56 are in an assembled position. The opposed second end portion 98 of the elongated second opening 90 of the first intermediate plate 56 extends in the direction of the opposed second side 88 of the first intermediate plate 56 and is substantially centrally disposed between the first side 86 and the opposed second side 88 of the first intermediate plate 56. The opposed second end portion 98 of the elongated second opening 90 is sized to be substantially equal to the first end portion 96 of the elongated second opening 90 such that a coin disposed in the coin passageway of the coin tube 14 and the first opening 72 of the upper plate 54 can readily pass through the second end portion 98 of the elongated second opening 90 of the first intermediate plate 56. The second elongated clearance slot 92 of the first intermediate plate 56 is provided with a first end 100 and an opposed second end 102. The first end 100 of the second elongated clearance slot 92 openly communicates with the opposed second end portion 98 of the elongated second opening 90; and, the opposed second end 102 of the second elongated clearance slot 92 extends from the elongated second opening 90 in the direction of the opposed second side 88 of the first intermediate plate 56. The elongated second opening 90 and the second elongated clearance slot 92 are disposed within the first intermediate plate 56 such that a central axis is common to each. Further, the opposed second end 102 of the second elongated clearance slot 92 terminates a distance 104 from the opposed second side 88 of the first intermediate plate 56. The distance 104 between the opposed second end 102 of the second elongated clearance slot 92 and the opposed second side 88 of the first intermediate plate 56 is substantially equal to the distance 80 between the second end 78 of the first elongated clearance slot 74 and the opposed second side 70 of the upper plate 54.

Each of the first pair of elongated guide slots 94 disposed in the first intermediate plate 56 are provided with a first end 106 and an opposed second end 108. The opposed second end 108 of each of the first guide slots 94 openly communicate with the first end portion 96 of the elongated second opening 90; and, the first end 106 of each of the elongated guide slots 94 extend from the first end portion 96 of the elongated second opening 90 in the direction of the first side 86 of the first intermediate plate 56. The first end 106 of each of the first pair of the elongated guide slots 94 terminate within the first intermediate plate 56 a distance 110 from the first side 86 of the intermediate plate 56. Further, the first pair of elongated guide slots 94 are disposed within the first intermediate plate 56 so as to be in a parallel, spatial relationship with each other.

The second intermediate plate 58 of the base plate 12 is provided with an upper side 112, an opposed lower side 114, a first side 116, and an opposed second side 118. The second intermediate plate 58 is further provided with a third opening 120, a third elongated clearance slot 122 and a second pair of elongated guide slots 124 extending therethrough. The third opening 120 is substantially centrally disposed in the second intermediate plate 58 at a position between the first side 116 and the opposed second side 118. The third elongated clearance slot 122 is provided with a first end 126 and an opposed second end 128. The first end 126 of the third elongated clearance slot 122 openly communicates with the third opening 120; and, the opposed second end 128 of the third elongated clearance slot 122 extends from the third opening 120 in the direction of the opposed second side 118 of the second intermediate plate 58 and terminates a distance 130 from the opposed second side 118 of the second intermediate plate 58. The third opening 120 and the third elongated clearance slot 122 are disposed within the second intermediate plate 58 such that a central axis is common to each of the third opening 120 and the third elongated clearance slot 122. Further, the distance 130 between the opposed second end 128 of the third elongated clearance slot 122 and the opposed second side 118 of the second intermediate plate 58 is substantially equal to the distance 104 between the opposed second end 102 of the second elongated clearance slot 92 and the opposed second side 88 of the first intermediate plate 56, and thus the distance 80 between the second opposed end 78 of the first clearance slot 54 and the opposed second side 70 of the upper plate 54.

Each of the second pair of elongated guide slots 124 are provided with a first end 132 and an opposed second end 134. The opposed second end 134 of each of the second pair of elongated guide slots 124 openly communicates with the third opening 120; and, the first end 132 of each of the second pair of elongated guide slots 124 extend from the third opening 120 in the direction of the first side 116 of the second intermediate plate 58 and terminate a distance 136 from the first side 116 of the second intermediate plate 58. The second pair of elongated guide slots 124 of the second intermediate plate 58 are disposed within the second intermediate plate 58 in a parallel, spatial relationship with each other. Further, the distance 136 defining the distance between the first end 132 of each of the second pair of elongated guide slots 124 and the first side 116 of the second intermediate plate 58 is substantially equal to the distance 110 between the first end 106 of the first pair of elongated guide slots 94 and the first side 86 of the first intermediate plate 56.

The lower plate 60 is provided with an upper side 138, an opposed lower side 140, a first side 142 and an opposed second side 144. The lower plate is further provided with a fourth opening 146, a fourth elongated clearance slot 148, and the recessed portion 42. The fourth opening 146 is disposed in the lower plate 60 such that the fourth opening 146 is substantially centrally positioned between the first side 142 and the opposed second side 144 of the lower plate 60. The fourth elongated clearance slot 148 is provided with a first end 150 and an opposed second end 152. The first end 150 of the fourth elongated clearance slot 148 openly communicates with the fourth opening 146; and, the opposed second end 152 of the fourth elongated clearance slot 148 extends from the fourth opening 146 in the direction of the opposed second side 144 of the lower plate 60. The opposed second end 152 of the fourth elongated clearance slot 148 terminates a distance 154 from the opposed second side 144 of the lower plate 60. The distance 154 between the opposed second end 152 of the fourth elongated clearance slot 148 and the opposed second side 144 of the lower plate 60 is substantially equal to the distance 130 between the opposed second end 128 of the third elongated clearance slot 122 and the opposed second side 118 of the second intermediate plate 58. Further, the fourth opening 146 and the fourth elongated clearance slot 148 of the lower plate 60 are positioned therein such that a central axis is common to each.

Figure 8A:
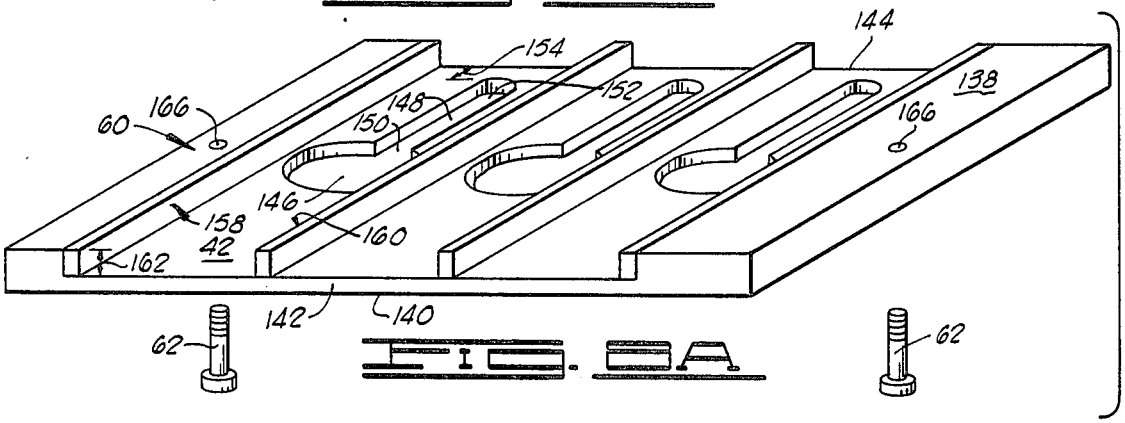

As previously stated, the lower plate 60 is also provided with the recessed portion 42, an elongated recessed area adapted to slidably receive the coin ejecting assembly 16 when the base plate 12 (formed of the upper plate 54, the first intermediate plate 56, the second intermediate plate 58, and the lower plate 60), is in the assembled position. The recessed portion 42 which openly extends through at least a portion of the upper side 138 of the lower plate 60 is formed by a first shoulder 158 and a second shoulder 160. The first and second shoulders 158, 160 are disposed within the lower plate 60 so that the first and second shoulders 158, 160 are substantially perpendicular to the first side 142 and the opposed second side 144 of the lower plate 60. Further, the first and second shoulders 158, 160 are in a parallel, spatial relationship with each other, and are positioned a distance from the side portions of the fourth opening 146 substantially as shown in FIG. 8A. Thus, the recessed portion formed by the cooperation of the first shoulder 158 and the second shoulder 160 slidably receives the coin ejecting assembly 16. The recessed portion 42 is provided with a depth 162 which is greater than the thickness of a rectangularly shaped body member 164 of the coin ejecting assembly 16 as will be described in detail hereinafter.

As previously set forth, the upper plate 54, the first intermediate plate 56, the second intermediate plate 58, and the lower plate 60 form the base plate 12 of the coin release assembly 10. In assembling the base plate 12, the body member 164 of the coin ejecting assembly 16 is positioned in the recessed portion 42 of the lower plate 60 and the lower plate 60 is positioned adjacent the second intermediate plate 58 via the upper side 138 of the lower plate 60 and the opposed lower side 114 of the second intermediate plate 58. Thereafter, the upper side 112 of the second intermediate plate 58 is abutted against the opposed lower side 84 of the first intermediate plate 56; and, the upper side 82 of the first intermediate plate 56 is abutted against the opposed lower side 66 of the upper plate 54. The upper plate 54, the first intermediate plate 56, the second intermediate plate 58 and the lower plate 60, having the body member 164 of the coin ejecting assembly 16 slidably positioned within the recessed portion 42 of the lower plate 60, can be secured together by any suitable means. For example, the lower plate 60, the second intermediate plate 58, the first intermediate plate 56 and the upper plate 54 of the base plate 12 can each be provided with a plurality of apertures, such as apertures 166, 168, 170 and 172. The apertures 166, 168, 170 and 172 are positioned so as to be alignable with each other when the upper plate 54, the first intermediate plate 56, the second intermediate plate 58, and the lower plate 60 are in the assembled position. The screws 62 can thereafter be inserted into the aligned apertures and secured therein by any suitable means such as a nut, or by tapping the aperture 172 in the upper plate 54 as illustrated in FIG. 8.

In the assembled position of the base plate 12, a portion 174 of the second intermediate plate 58 (e.g., the portion of the second intermediate plate disposed between the third opening 120 and the second pair of elongated guide slots 124 of the second intermediate plate 58) is disposed within an opening formed by the passageway 24 and the coin exit opening 23 of the coin tube 14, the first opening 72 of the upper plate 54, and the first end portion 96 of the elongated second opening 90 of the first intermediate plate 56. Thus, the portion 174 of the second intermediate plate 58 disposed within the beforementioned opening (e.g., the opening formed by the passageway 24 and the coin exit opening 23 of the coin tube 14, the first opening 72 of the upper plate 54, and the first end portion 96 of the elongated second opening 90 of the first intermediate plate 56) serves as a support member for supporting the coin elements in the coin exit opening 23 and the passageway 24 of the coin tube 14. This unique arrangement of the upper plate 54, the first intermediate plate 56, the second intermediate plate 58 and the lower plate 60 prevents the weight of the coin elements in the passageway 24 and the coin exit opening 23 of the coin tube 14 from being placed on the coin ejecting assembly 16. In addition, the first intermediate plate 56 is provided with a thickness greater than the thickness of the largest coin element which the coin release assembly is adapted to receive.

Referring now to FIGS. 4, 5, 7 and 8, the coin ejecting assembly 16 comprises the body member 164, coin engaging means 176, the linkage assembly 28, and the activation means, such as the solenoid 26. The body member 164, a substantially rectangularly shaped body member adapted to be slidably positioned in the recessed portion 42 formed in the lower plate 60 of the base plate 12, is provided with a first end portion 178, an opposed second end portion 180, an upper side 182, and an opposed lower side 184. The body member 164 is further provided with a fifth opening 186 extending therethrough, the fifth opening 186 being disposed in the body member 164 in close proximity to the first end portion 178 thereof, the fifth opening 186 having a diameter sufficient to allow the coin element to pass therethrough when the body member 164 of the coin ejecting assembly 16 is moved to the second position.

The coin engaging means 176 are positioned on the upper side 182 of the body member 164 in close proximity to the first end portion 178 of the body member 164. The coin engaging means 176 are constructed such that, in the assembled position of the base plate 12, the coin engaging means 176 operatively engage the lowermost coin element supported in the coin exit opening 23 of the passageway 24 of the coin tube 14 by the portion 174 of the second intermediate plate 58 (e.g. the portion of the second intermediate plate 58 formed between the third opening 120 and the second pair of elongated guide slots 124) as hereinbefore described.

The coin engaging means 176 comprises a pair of coin engaging members 188, 190 positioned on the upper side 182 of the body member 64. The coin engaging member 188 is provided with a first end 192 and an opposed second end 194; and, the coin engaging member 190 is provided with a first end 196 and an opposed second end 198. The first end 192 of the coin engaging member 188 is provided with a curved surface 200 substantially corresponding to the surface of the fifth opening 186 of the body member 164. Similarly, the first end 196 of the coin engaging member 190 is provided with a curved surface 202 substantially corresponding to the surface of the fifth opening 186 of the body member 164. The coin engaging members 188, 190 are positioned in a substantially parallel, spatial relationship and the coin engaging member 188 is positioned in close proximity to one side of the fifth opening 186 of the body member 164; and, the coin engaging member 190 is positioned in close proximity to an opposed second side of the fifth opening 186 of the body member 164 substantially as shown in FIG. 8. Thus, the coin engaging member 188 is positioned on the upper side 182 of the body member 164 such that the curved surface 200 of the first end 192 of the coin engaging member 188 is positioned adjacent the fifth opening 186 and the opposed second end 194 of the coin engaging member 188 extends in the direction of the first end portion 178 of the body member 164. Similarly, the coin engaging member 190 is positioned on the upper side 182 of the body member 164 such that the curved surface 202 of the first end 196 of the coin engaging member 190 is positioned adjacent the fifth opening 186 such that the opposed second end 198 of the coin engaging member 190 extends in the direction of the first end portion 178 of the body member 164.

Referring to FIGS. 4 and 5, the linkage assembly 28 (which is operably connected to the opposed second end portion 180 of the body member 164) comprises a first linkage member 204, a rocker member 206, and a second linkage member 208. The first linkage member 204, depicted as an elongated, rectangularly shaped member, is provided with a first end 210 and an opposed second end 212. The first linkage member 204 further comprises a first yoke 214 disposed on the first end 210 of the first linkage member 204; and, a second yoke 216 disposed on the opposed second end 212 of the first linkage member 204. The first end 210 of the first linkage member 204 is connected to the activation means, such as the solenoid 26, via the first yoke 214 and the second linkage member 208 (as will be described hereinafter); and, the opposed second end 212 of the first linkage member 204 is connected to a first end 218 of the rocker member 206 via the second yoke 216, and thus to the body member 164 as will also will be discussed in detail hereinafter.

The first yoke 214 comprises a first leg 220 and a second leg 222, each of the first and second legs 220, 222 having an aperture therein, the aperture of the first leg 220 being aligned with the aperture of the second leg 222 and adapted to receive a first pin 224 therethrough. The first and second legs 220, 222 of the first yoke 214 are disposed in a parallel, spatial relationship with each other.

The second yoke 216 comprises a first leg 226 and a second leg 228. The first and second legs 226, 228 of the second yoke 216 are each provided with an aperture therein, the aperture of the first leg 226 being aligned with the aperture of the second leg 228 and adapted to receive a second pin 230. The first and second legs 226, 228 of the second yoke 216 are disposed in a parallel, spacial relationship with each other.

The rocker member 206, which interconnects the first linkage member 204 to the body member 164, is provided with the first end 218 and a second end 232.

As previously stated, the first end 218 of the rocker member 206 is pivotably connected to the opposed second end 212 of the first linkage member 204 via the second yoke 216; and, the second end 232 of the rocker member 206 is operably connected to the body member 164.

The rocker member 206 comprises a first arm member 234 having a first end portion 236 and an opposed second end portion 238 and, a second arm member 240 having a first end portion 242 and an opposed second end portion 244. The first end portion 236 of the first arm member 234 abuts the opposed second end portion 244 of the second arm member 240 such that a substantially L-shaped rocker member 206 is formed. The first end portion 242 of the second arm 240 of the rocker member 206 is provided with a vertically disposed bore (not shown) extending therethrough. The opposed second end portion 238 of the first arm member 234 of the rocker member 206 is provided with a generally rectangular, tapered configuration substantially as shown in FIGS. 4 and 5. The rocker member 206 is pivotably connected to the first linkage member 204 via the second yoke 216 (by positioning the first end portion 242 of the second arm member 240 of the rocker member 206 within the second yoke 216 such that the bore (not shown) in the first end portion 242 of the second arm 240 is aligned with the apertures (not shown) in the first and second legs 226, 228 of the second yoke 216 and the second pin 230 positioned through the aligned apertures and the bore. The first arm member 234 of the rocker member 206 is positioned through the aligned first, second and third elongated clearance slots 74, 92, 122 of the upper plate 54, the first intermediate plate 56, and the second intermediate plate 58, respectively, such that the substantially rectangularly shaped, tapered opposed second end portion 238 of the second arm member 234 of the rocker member 206 is disposed within a rectangularly shaped opening 246 in the opposed second end portion 280 of the body member 164 of the coin ejecting assembly 16 as more clearly shown in FIG. 4. The second end portion 238 of the first arm member 234 of the rocker member 206 may extend through the rectangularly shaped opening 246 in the opposed second end portion 280 of the body member 164 and into the fourth elongated clearance slot 148 of the lower plate 60.

The second linkage member 208, depicted as a generally rectangularly shaped member, is provided with a first end portion 248 and an opposed second end portion 250. The first end portion 248 of the second linkage member 208 is connected to the activation means, such as the solenoid 26; and, the opposed second end portion 250 of the second linkage member 208 is connected to the first linkage member 204 via the first yoke 214.

As shown more clearly in FIG. 4, the second linkage member 208 is connected to the first linkage member 204 such that the second linkage member 208 is disposed substantially perpendicular to the longitudinal axis of the first linkage member 204. The attachment of the second linkage member 208 to the first linkage member 204 via the opposed second end portion 250 of the second linkage member 208 and the first yoke 214 can be accomplished by providing a vertically disposed bore (not shown) extending through the opposed second end portion 250 of the second linkage member 208, aligning the vertically disposed bore in the opposed second end portion 250 of the second linkage member 208 with the apertures (not shown) in the first and second legs 220, 222 of the first yoke 214, and positioning the first pin 224 therethrough. The first end portion 248 of the second linkage member 208 can be secured to the activation means, such as the solenoid 26, (the solenoid having a reciprocating plunger 252), by providing a vertically disposed bore in the first end portion 248 of the second linkage member 208, a threaded bore (not shown) in an outwardly extending end portion 254 of the reciprocating plunger 252 of the solenoid 26, and positioning a fastening element, such as a screw 256, through the vertically disposed bore in the first end portion 248 of the second linkage member 208 and threadably engaging the bore (not shown) in the outwardly extending end 254 of the reciprocating plunger 252.

Referring now to FIGS. 1–6, the coin release assembly 10 further comprises a plurality of first support members 260, a plurality of second support members 262, a first biasing means, such as a first spring 264, and a second biasing means, such as a second spring 266. Each of the first support members 260 is a substantially rectangularly shaped member and is provided with an upper end portion 268, an opposed lower end portion 270, a front side 272, an opposed back side 274, a first side 276, and an opposed second side 278. Each of the first support members 260 is secured to the back support plate 44 through the front side 50 of the back support plate 44 and the opposed back side 274 of the first support members 260. The first support members 260 are mounted on the back support plate 44 such that the first linkage member 204 is disposed between two adjacent first support members 260. Further, the first support members 260 are maintained in a substantially parallel, spatial relationship with each other substantially as shown in FIGS. 2 and 4.

Each of the first support members 260 is positioned on the back plate 44 such that the upper end portion 268 of the first support members 260 is disposed in close proximity to the upper end portion 46 of the back support plate 44; and, the opposed lower end portion 270 of each of the first support members 260 terminates a distance 280 above the opposed second end of the first linkage member 204. Further, each of the first support members 260 are provided with an aperture (not shown) therein. The apertures in the first support members 260 being alignable with the aperture in each adjacent first support members 260 such that a third pin 282 can be positioned through the aligned apertures of the first support members 260. The aligned apertures, and thus the third pin 282, are positioned a distance from the first linkage member 204 such that the third pin 282 does not interfere in the movement of the first linkage member 204.

The second spring 266 is provided with a first end 284 and an opposed second end 286. The first end 284 of the second spring 266 is connected to the third pin 282; and, the opposed second end 286 of the second spring 266 is connected to the second linkage member 208 by any suitable means, such as angle bracket 288. Thus, the second spring 266, e.g., the second biasing means, is operably connected between the second linkage member 208 and the third pin 282 so that the reciprocating plunger 252 of the solenoid 26 is biased in the inactive position (the extended position). Therefore, the body member 164 of the coin ejecting assembly 16 is maintained in the first position via the first linkage member 204, the second linkage member 208, and the rocker member 206 when the solenoid 26 is in an inactive condition.

Referring now to FIGS. 1–4, 6 and 7, the second support members 262 are each provided with an upper end 290, an opposed lower end 292, a front side 294, an opposed back side 296, a first side 298, and an opposed second side 300. The second support members 262 are secured to the base plate 12 and the back support plate 44 at the junction formed therebetween substantially as shown in FIGS. 1, 2, 4, 6 and 7. Thus, each of the second support members 262 is secured to the base plate 12 through the upper side 30 of the base plate 12 and the opposed lower end 292 of the second support member 262; and, to the back support plate 44 via the front side 50 of the back support plate 44 and the opposed backside 296 of the second support members 262. The second support members 262 are each provided with an aperture (not shown) therein, each of the apertures of each second support members 262 being aligned with the aperture in each adjacent second support members 262. Further, each of the second support members 262 are disposed on the upper side 30 of the base plate 12 and the front side 50 of the back support plate 44 so as to not interfere with the movement of any of the components of the linkage assembly 28.

Figure 6:
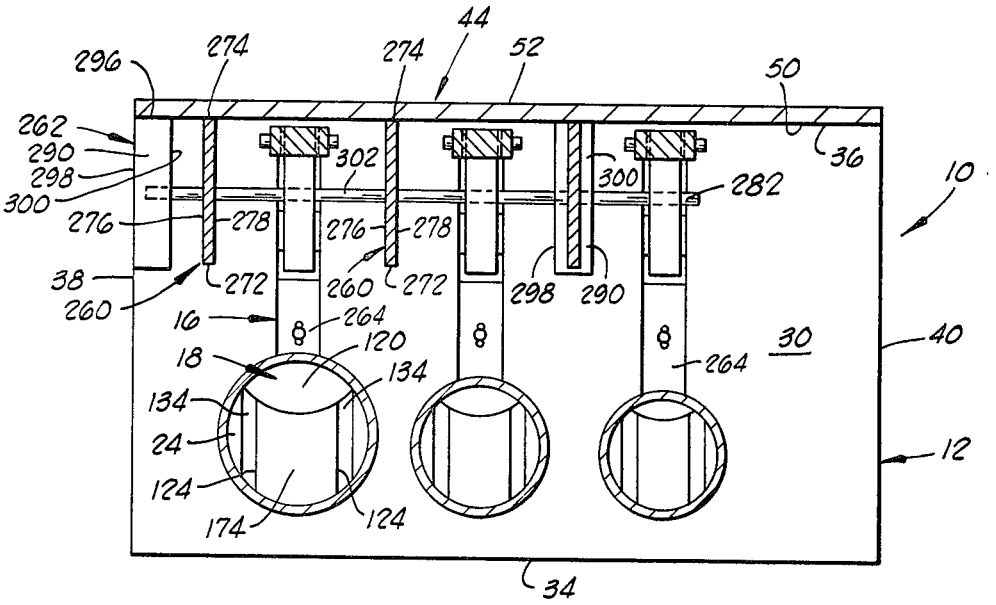
FIG. 6 is a cross sectional view taken substantially over the upper side of the base plate of the coin release assembly of FIG. 1.

The rocker member 206 is provided with a substantially vertically disposed bore (not shown) extending therethrough, the bore being disposed in the rocker member 206 at the junction of the first arm member 234 and the second arm member 240 substantially as shown in FIG. 4. The rocker member 206 is positioned between the second support members 262 such that the bore (not shown) in the rocker member 206 is aligned with the apertures (not shown) of each of the second support members 262. A fourth pin 302 is positioned within the aligned apertures (not shown) of the second support members 262 and the bore (not shown) in the rocker member 206 for pivotably mounting the rocker member 206 to the second support members 262 via the fourth pin 302 substantially as shown in FIGS. 4, 5 and 6.

Referring to FIGS. 2 and 4, the first biasing means, e.g., the first spring 264, is operably connected to the body member 164 of the coin ejecting assembly 16 for biasing the body member 164 in an upward direction in the recessed portion 42 of the lower plate 60 and against the opposed lower side 114 of the second intermediate plate 58. The first spring 264 is provided with a first end 304 and an opposed second end 306. The first end 304 of the first spring 264 is connected to the body member 164 by any suitable means, such as providing an aperture 308 extending through the body member 164, the aperture 308 being disposed between the fifth opening 186 in the body member 164 and the rectangularly shaped opening 246 in the body member 164. The first spring 264 extends upwardly through the first elongated clearance slot 74, the second elongated clearance slot 92, and the third elongated clearance slot 122 of the second intermediate plate 58, the first intermediate plate 56 and the upper plate 54, respectively, and the opposed second end 306 of the first spring 264 is secured to an exterior portion 310 of the coin tube 14 by any suitable means, such as an eylet member 312 secured to the exterior portion 310 of the coin tube 14. The biasing of the body member 164 in an upward direction against the opposed lower side 114 of the second intermediate plate 58 insures that when the body member 164 is in the first position, the coin engaging members 188, 190 of the coin engaging means 176 are operably disposed to engage the lowermost coin supported in the coin tube 14 as hereinbefore described. Further, upon activation of the activation means, e.g., the solenoid 26, the body member 164 is moved to the second position (via the reciprocating plunger 252 of the solenoid 26, the second linkage member 208, the first linkage member 204, and the rocker member 206) so that the lowermost coin element in the coin tube 14 is withdrawn from the supported position, passed through first end portion 96 of the elongated second opening 90 of the first intermediate plate 56, and thereafter through the fifth opening 186 in the body member 164, and the aligned fourth opening 146 in the lower plate 60. The movement of the body member 164 of the coin ejecting assembly 16 from the first position to the second position is, as previously stated, illustrated in FIG. 7 of the drawings.

The above operation of the removal of the lowermost coin element from the passageway 28 of the coin tube 14 via the coin exit opening 23 is move clearly illustrated in FIG. 4 when viewed in combination with FIGS. 7 and 8. As more clearly depicted in FIGS. 4 and 8, the first pair of elongated guide slots 94 disposed in the first intermediate plate 56 are aligned with the second pair of elongated guide slots 124 of the second intermediate plate 58. The coin engaging members 188, 190 of the body member 164 of the coin ejecting assembly 16 are positioned within the aligned first pair of elongated guide slots 94 and the second pair of elongated guide slots 124 and extend through such elongated guide slots to a distance above the second intermediate plate 58 so as to engage the lowermost coin element supported in the passageway 24 of the coin tube 14, for removal of same by the movement of the body member 164 from the first position to the second position. The biasing of the body member 164 in the upward direction is important to insure engaging contact of the coin engaging members 188, 190 of the coin engaging means 176 with the lowermost coin element in the passageway 24 of the coin tube 14, and thus to insure effective removal of the coin element therefrom. Further, when the body member 164 has been moved from the first position to the second position for removal of the coin element, and is thereafter returned to the first position by inactivation of the solenoid 26, the biasing of the body member 164 enables the coin engaging members 188, 190 to pass beneath the lowermost coin now supported in the passageway 24 of the coin tube 14 such that upon reaching the first position, the body member 164 is biased upwardly for engaging contact with the lowermost coin element in the passageway 24 of the coin tube 14 via the coin engaging members 188, 190 for subsequent removal of the coin element therefrom upon activation of the solenoid 26.

The coin release assembly 10 of the present invention can be employed in combination with a coin separator assembly, a vending machine, and the like, such being illustrated in FIGS. 1 and 2 in phantom and represented by the numeral 314. The activation means, such as the solenoid 26, can be secured to the back support plate 44 such as by the bracket assembly 316. In addition, while the present invention has been described with reference to one coin tube 14, one coin ejecting assembly 16, one solenoid, and one linkage assembly 28, the coin release assembly 10 can be designed and function in an identical manner whether a plurality of such elements are employed, such as three as illustrated in FIGS. 1–3, 6 and 7, or even a greater number of such elements without detracting from the effectiveness and desirability of the present invention.

While the subject invention has been described in terms of certain preferred embodiments, and illustrated by certain drawings, such are intended for illustrative purposes only and alternatives or equivalents may readily occur to those skilled in the art without departing from the spirit or scope of the invention as set forth in the appended claims.

What is claimed is:

1. A coin release assembly for selectively removing a coin element therefrom, the assembly comprising:

a base plate having an opening extending therethrough and a recessed portion for slidably receiving the coin ejecting assembly;

a coin tube having a first end, an opposed second end, and a coin passageway extending therethrough for receiving coin elements, the opposed second end of the coin tube having mounted to the base plate such that the coin passageway of the coin tube is offset with respect to the opening in the base plate and a portion of the base plate being disposed for supporting the coin elements within the coin passageway of the coin tube;

a coin ejecting assembly operably disposed in the base plate, the coin ejecting assembly engaging a lowermost coin element in the coin passageway of the coin tube such that upon activation of the coin ejecting assembly the coin ejecting assembly is moved from a first position wherein the coin ejecting assembly operably engages the lowermost coin element supported in the coin passageway to a second position wherein the coin element engaged by the coin ejecting assembly is removed from the coin passageway of the coin tube and aligned with the opening in the base plate such that the coin element exits the base plate via the opening therein, the coin ejecting assembly comprising:

a body member having a first end and an opposed second end portion and being operably disposed in the recessed portion of the base plate, the body member having an upper side, an opposed lower side and an opening extending therethrough, the opening having a diameter sufficient to allow a coin element to pass therethrough when the body member is in the second position;

at least one coin engaging member positioned on the upper side of the body member for operably engaging the lowermost coin element; and means connected to the body member for moving the body member from the first position to the second position and for moving the body member from the second position to the first position, the coin engaging member engaging the lowermost coin element and moving the lowermost coin element from the coin tube to a position for allowing the coin element to be discharged through the opening in the base plate when the body member moves from the first to the second position; and a first biasing means operably connected to the body member for biasing the body member in an upward direction in the recessed portion of the base plate generally toward the coin elements in the coin tube to insure engaging contact between coin engaging member and the coin element when the body member is moved from the first to the second position, the coin elements in the coin tube biasing the body member in a downward direction in the recessed portion of the base plate when the body member is moved from the second to the first position to effectively reduce the weight of the coin elements on the body member thereby reducing the force required to move the body member from the first to the second position.

2. The coin release assembly of claim 1 wherein the coin ejecting assembly comprises:

a linkage assembly operably connected to the opposed second end portion of the body member; and activation means operably connected to the linkage assembly such that on activating the activating means the body member is moved from the first position to the second position via the linkage assembly.

3. The coin release assembly of claim 1 wherein coin engaging members are defined further as including:

a pair of coin engaging members positioned on the upper side of the body member, each of the coin engaging members having a first end and an opposed second end, the first end of each of the coin engaging members having a curved surface corresponding to the surface of the opening in the body member, the coin engaging members being maintained in a substantially parallel, spatial relationship, one of the coin engaging members being positioned in close proximity to a first side of the opening and the other of the coin engaging members being positioned in close proximity to an opposed second side of the opening, the curved surface of the first end of each of the coin engaging members being positioned adjacent the opening such that the opposed second end of each of the coin engaging members extends in the direction of the first end of the body member.

4. The coin release assembly of claim 2 wherein the linkage assembly comprises:

a linkage member having a first end and an opposed second end;

a rocker member having a first end and a second end, the first end of the rocker member being pivotally connected to the opposed second end of the linkage member, the second end of the rocker member connected to the opposed second end of the coin eject member, and the first end of the linkage member being operably connected to the activation means.

5. The coin release assembly of claim 4 wherein the linkage assembly further comprises a second linkage member, the second linkage member having a first end portion and an opposed second end portion, the first end portion of the second linkage member being connected to the activation means and the opposed second end portion of the second linkage member being connected to the first end of the first linkage member such that the second linkage member is disposed substantially perpendicular to the first linkage member.

6. The coin release assembly of claim 5 which further comprises a second biasing means operably connected to the second linkage member for biasing the activation means in the inactive position such that the coin ejecting assembly is maintained in the first position when the activation means is in an inactive condition.

7. The coin release assembly of claim 6 wherein the rocker member comprises:

a first arm member having a first end portion and an opposed second end portion; and a second arm member having a first end portion and an opposed second end portion, the first end portion of the first arm member abutting the opposed second end portion of the second arm member such that a substantially L-shaped rocket member is formed.

8. The coin release assembly of claim 7 wherein the first linkage member further comprises:

a first yoke disposed on the first end of the first linkage member; and a second yoke disposed on the opposed second end of the first linkage member, the second yoke adapted to receive the first end portion of the second arm member, the first yoke adapted to receive the opposed second end portion of the second linkage member.

9. The coin release assembly of claim 8 wherein:

the first yoke is characterized as having a first leg and a second leg, the first and second legs of the first yoke being maintained in a parallel, spatial relationship, each of the first and second legs of the first yoke having an aperture therein, the aperture of the first leg being aligned with the aperture of the second leg; and the second yoke is characterized as having a first leg and a second leg, the first and second legs of the second yoke being maintained in a parallel, spatial relationship, each of the first and second legs of the second yoke having an aperture therein, the aperture of the first leg being aligned with the aperture of the second leg.

10. The coin release assembly of claim 9 wherein the opposed second end portion of the second linkage member is provided with a vertically disposed bore extending therethrough, the first end portion of the second arm of the rocker member is provided with a vertically disposed bore extending therethrough, and wherein the linkage assembly further comprises:

a first pin; and a second pin, the first pin connecting the opposed second end portion of the second linkage member within the first yoke of the first linkage member when the opposed second end portion of the first linkage member is positioned within the first yoke of the first linkage member such that the bore in the opposed second end portion of the second linkage member is aligned with apertures in the first and second legs of the first yoke and the first pin is positioned therethrough, the second pin pivotably connecting the first end portion of the second arm of the rocker member within the second yoke of the first linkage member such that the bore in the first end portion of the second arm of the rocker member is aligned with the apertures in the first and second legs of the second yoke and the second pin is positioned therethrough.

11. The coin release assembly of claim 10 wherein the base plate is further characterized as having an upper side, an opposed lower side, a first side, an opposed second side, a first end and an opposed second end, and wherein the coin release assembly further comprises a back support plate having an upper end portion, an opposed lower end portion, a front side, and an opposed back side, the opposed lower end portion of the back support plate being secured through the front side of the back support plate to the opposed second side of the base plate such that the back support plate extends substantially vertically from the base plate and substantially parallel to the coin tube.

12. The coin release assembly of claim 11 which further comprises:

a plurality of first support members secured to the back support plate via the front side, the first support member being maintained in a substantially parallel, spatial relationship with each other such that the first linkage member is disposed between two adjacent first support members, each of the first support members extending from the upper end portion of the back support plate in the direction of the lower end portion of the back support plate, each of the first support members terminating a distance above the opposed second end portion of the first linkage member, each of the first support members having an aperture therein, the apertures in the first support members being aligned with one another, the apertures being disposed within the first support members at a position intermediate the first and opposed second end portion of the first linkage means.

13. The coin release assembly of claim 12 wherein the first biasing means comprises:

a first spring having a first end and an opposed second end, the first end of the first spring being connected to the body member at a position between the opening in the body member and the position of attachment of the second end of the rocker member to the body member, the opposed second end of the first spring being connected to an exterior surface of the coin tube such that the body member is biased in the direction of the upper side of the base plate.

14. The coin release assembly of claim 13 which further comprises:

a third pin positioned in the aligned apertures of the first support members, the third pin being removed from the first linkage member a distance to prevent interference in the movement of the first linkage member by the third pin.

15. The coin release assembly of claim 14 defined further to include:

a second spring having a first end and an opposed second end, the first end of the second spring being connected to the third pin, the opposed second end of the second spring being connected to the second linkage member such that in an assembled position the activation means is biased to maintain the body member in the first position when the activation means is in an inactivated condition.

16. The coin release assembly of claim 15 wherein the rocker member is provided with a substantially vertically disposed bore extending therethrough, the bore being disposed in the rocker member at the junction of the first and second arm members of the rocker member, and wherein the coin release assembly further comprises:

a plurality of second support members, secured to the base plate via the upper side and to the back support plate via the front side at the junction of the base plate and the back plate, the second support member being maintained in a substantially parallel, spatial relationship with each other such that the rocker member is disposed therebetween, each of the second support members having an aperture therein, each of the apertures being aligned one with another and with the bore in the rocker member when the activation means is in an inactivated condition and biased such that the body member is in the first position; and a fourth pin positioned in the aligned apertures of the second support members and the bore in the rocker member for pivotably mounting the rocker member to the second support members via the fourth pin.

17. The coin release assembly of claim 1 wherein the base plate is formed of multiplate construction and the base plate comprises:

an upper plate having an upper side, an opposed lower side, a first side, and an opposed second side, the upper plate further characterized as having a first opening and a first elongated clearance slot extending therethrough, the first opening positioned in close proximity to the first side of the upper plate for receiving the opposed second end of the coin tube, the first elongated clearance slot having a first end and an opposed second end, the first end of the first clearance slot opening by communicating with the opening in the upper plate and the opposed second end of the first clearance slot extending from the first opening in the direction of the opposed second side of the upper plate and terminating within the upper plate a distance from the opposed second side, the first opening and the first elongated clearance slot being positioned such that a central axis is common to each;

a first intermediate plate having an upper side, an opposed lower side, a first side, and an opposed second side, the first intermediate plate further characterized as having an elongated second opening extending therethrough, a second elongated clearance slot and a first pair of elongated guide slots, the elongated second opening having a first end portion and an opposed second end portion, the first end portion of the elongated second opening being substantially centrally disposed between the first side and the opposed second side of the first intermediate plate, the opposed second end portion of the elongated second opening extending in the direction of the opposed second side of the first intermediate plate, the second elongated clearance slot having a first end and an opposed second end, the first end of the second clearance slot openly communicating with the elongated second opening via the opposed second end portion of same, the opposed second end of the second clearance slot extending from the elongated second opening in the direction of the opposed second side, the elongated second opening and the second elongated clearance slot being positioned within the first intermediate plate such that a central axis is common to each, each of the pair of the first elongated guide slots being provided with a first end and an opposed second end, the opposed second end of each of the first guide slots openly communicating with the elongated second opening via the first end portion of the elongated second opening, the first end of each of the guide slots extending from the elongated second opening in the direction of the first side of the first intermediate plate and terminating within the first intermediate plate a distance from the first side, the pair of first guide slots being maintained in a parallel spatial relationship;

a second intermediate plate having an upper side, an opposed lower side, a first side, and an opposed second side, the second intermediate plate further characterized as having a third opening, a third elongated clearance slot, and a second pair of elongated guide slots extending therethrough, the third opening being substantially centrally disposed between the first side and the opposed second side of the second intermediate plate member, the third elongated clearance slot having a first end and an opposed second end, the first end of the third elongated clearance slot openly communicating with the third opening and the opposed second end of the third clearance slot extending from the third opening in the direction of the opposed second side of the second intermediate plate and terminating within the second intermediate plate a distance from the opposed second side, the third opening and the third elongated clearance slot being positioned within the second intermediate plate such that a central axis is common to each, each of the second pair of elongated guide slots being provided with a first end and an opposed second end, the opposed second end of each of the second pair of guide slots opening by communicating with the third opening, the first end of each of the second pair of guide slots extending from the third opening in the direction of the first side of the second intermediate plate and terminating within the second intermediate plate a distance from the first side, the second pair of elongated guide slots being maintained in a parallel spatial relationship; and a lower plate member having an upper side, an opposed lower side, a first side and an opposed second side, the lower plate member further characterized as having a fourth opening and a fourth elongated clearance slot extending therethrough, and an elongated recess portion, the fourth opening being substantially centrally disposed between the first side and the opposed second side of the lower plate member, the fourth elongated clearance slot having a first end and an opposed second end, the first end of the fourth clearance slot openingly communicating with the fourth opening, the opposed second end of the fourth clearance slot extending from the fourth opening in the direction of the opposed second side of the lower plate and terminating within the lower plate a distance from the opposed side, the fourth opening and the fourth elongated clearance slot being positioned such that a central axis is common to each.

18. The coin release assembly of claim 17 wherein the base plate is further provided with a plurality of shoulders, the shoulders being disposed on the upper side of the lower plate in a parallel, spatial relationship with each adjacent shoulder, each of the shoulders extending substantially from the first side of the base plate to the opposed second side of the base plate, two adjacent shoulders cooperating with the upper side of the base plate to form the recessed portion for slidably receiving the body member of the coin ejecting assembly.

19. The coin release assembly of claim 18 which further comprises fastening means for securing the upper plate, the first intermediate plate, the second intermediate plate and the lower plate in an assembled position.

20. The coin release assembly of claim 19 wherein the activating means is a solenoid.

* * * * *